US005425261A

United States Patent [19]

Hellman, Sr. et al.

[11] Patent Number: 5,425,261

[45] Date of Patent: Jun. 20, 1995

[54] METHOD FOR FORMING THIN-WALL TUBING

[75] Inventors: Robert R. Hellman, Sr., 35 Hawley Rd., Oxford, Conn. 06483; Peter J. Mullen, New Milford, Conn.

[73] Assignee: Robert R. Hellman, Sr., Oxford, Conn.

[21] Appl. No.: 83,312

[22] Filed: Jun. 28, 1993

Related U.S. Application Data

[63] Continuation of Ser. No. 730,382, Jul. 15, 1991, abandoned, which is a continuation of Ser. No. 488,865, Mar. 5, 1990, abandoned, which is a continuation-in-part of Ser. No. 278,819, Dec. 1, 1988, Pat. No. 4,905,885.

[51] Int. Cl.[6] ..... B21C 37/06

[52] U.S. Cl. ..... 72/368; 72/148; 72/183

[58] Field of Search ..... 72/52, 183, 147, 367, 72/368, 146, 148, 406, 311; 242/59; 493/269, 303; 29/600; 343/877

[56] References Cited

U.S. PATENT DOCUMENTS

| | | | |
|---|---|---|---|
| 478,090 | 7/1892 | Crowell | 72/406 |
| 841,539 | 1/1907 | Kimsey . | |
| 974,288 | 11/1910 | McCarroll | 72/406 |
| 1,173,363 | 2/1916 | McCarroll | 72/406 |
| 1,620,042 | 3/1927 | Smith | 72/149 |
| 1,640,582 | 8/1927 | Smith | 72/406 |
| 1,977,503 | 10/1934 | Warren | 242/59 |
| 2,242,924 | 5/1941 | Schlattner | 72/406 |
| 2,977,914 | 4/1961 | Gray et al. | 113/33 |
| 2,998,047 | 8/1961 | Mally et al. | 153/54 |
| 3,136,202 | 6/1964 | Wagner | 72/146 |
| 3,144,104 | 8/1964 | Weir et al. | 72/146 |
| 3,465,567 | 9/1969 | Park | 343/877 |
| 3,608,844 | 9/1971 | Tumulty et al. | 242/54 A |
| 3,899,911 | 8/1975 | Ogier et al. | 72/169 |

FOREIGN PATENT DOCUMENTS

| | | | |
|---|---|---|---|
| 0039617 | 12/1975 | Japan | 72/147 |
| 0092231 | 7/1980 | Japan | 72/146 |
| 70330 | 3/1990 | Japan | 72/297 |
| 600982 | 4/1948 | United Kingdom | 72/321 |

*Primary Examiner*—Daniel C. Crane
*Attorney, Agent, or Firm*—John H. Crozier

[57] ABSTRACT

In a preferred embodiment, a method and apparatus for forming thin-wall tubing for later welding of the seam thereof which includes tightly rolling upon itself a sheet of thin metal stock about a roller between layers of a flexible fabric. When released from the roller, the sheet metal springs back to form a near-perfect tube without the kinks, scratches, and/or dents commonly caused by conventional rolling methods.

7 Claims, 7 Drawing Sheets

METHOD FOR FORMING THIN-WALL TUBING

This application is a continuation of application Ser. No. 07/730,382, filed Jul. 15, 1991, now abandoned, which is a continuation of application Ser. No. 07/488,865, filed Mar. 5, 1990, now abandoned, which is a continuation-in-part of application Ser. No. 07/278,819, filed Dec. 1, 1988, now U.S. Pat. No. 4,905,885, issued Mar. 6, 1990.

BACKGROUND OF THE INVENTION

1. Field of the Invention

The present invention relates to thin-wall tubing generally and, more particularly, to a novel method and apparatus for forming such tubing for later welding of the seam thereof, which method and apparatus economically produce a product having superior quality and in wider ranges of materials, diameters, and thicknesses than heretofore available.

2. Background Art

Thin-wall tubing is useful in a number of applications and is of particular value in the manufacture of metal bellows. Such bellows have utility in such varied applications as pressure and thermal sensors, seals, expansion joints and chambers, and vibration dampeners. The convolutions of the bellows are typically formed by mechanical means from welded thin-wall tubing, after the tubing is formed. Such bellows are manufactured, for example, by Westport Development Manufacturing Company, Inc., Orange, Conn. It will be understood that, in the manufacture of such bellows, it is of critical importance that the weld on the tubing used be strong and that the diameter of the tubing be uniform.

Known methods and apparatus for forming welded thin-wall tubing have a number of substantial limitations, one of which is the relatively high cost of the apparatus. In one type of apparatus, the basic tubing shape is formed from flat strip and the seam is welded by moving the tubing under a fixed welding torch. This type of apparatus relies on the formed tube itself for support, there being no internal support, and, therefore, there is a practical limit to the thinness of the tube. For example, the minimum wall thickness for a 4-inch diameter tube is on the order of 0.020 inch.

In another type of apparatus, the edges of the formed tube are fixedly clamped to a mandrel surface by means of a plurality of fingers and the welding torch is moved along the seam. This type of apparatus has the advantage of being able to weld a variety of shapes, in addition to round tubing, but has as one disadvantage the practical limitation of a relatively short maximum length. Also, the apparatus requires careful adjustment of a "springy" piece of sheet metal to butt the edges perfectly. Too high a clamping pressure will cause the mandrel to bend and too low a clamping pressure will cause the resulting tube to be tapered because it laps over during the welding and cooling process. If supports are added under the mandrel, there is a risk of marking or wrinkling the tube. Typically, the lower dimensional limits on tubes produced with this type of apparatus are 0.0055 wall thickness and $1\frac{1}{4}$-inch OD.

Neither type of apparatus has the ability to readily handle difficult to weld materials such as Monel and both tend to produce thin-wall tubing having kinks, scratches, and/or dents.

Accordingly, it is a principal object of the present invention to provide a method and apparatus for forming thin-wall tubing which will produce such tubing of wider ranges of wall thicknesses, diameters, and materials than available with conventional methods and apparatus.

Another object of the invention is to provide such method and apparatus which produces such tubing having a uniform diameter and no tapering.

An additional object of the invention is to provide such method and apparatus which produces such tubing of any desired length.

A further object of the invention is to provide such method and apparatus which is relatively economical and easy to use.

Other objects of the invention, as well as particular features and advantages thereof, will, in part, be obvious and will, in part, be apparent from the following description and the accompanying drawing figures.

SUMMARY OF THE INVENTION

The present invention accomplishes the above objects, among others, by providing, in a preferred embodiment, a method and apparatus for forming thin-wall tubing for later welding of the seam thereof which includes tightly rolling upon itself a sheet of thin metal stock about a roller between layers of a flexible fabric. When released from the roller, the sheet metal springs back to form a near-perfect tube without the kinks, scratches, and/or dents commonly caused by conventional rolling methods.

DETAILED DESCRIPTION OF THE PREFERRED EMBODIMENTS

Figure 1:
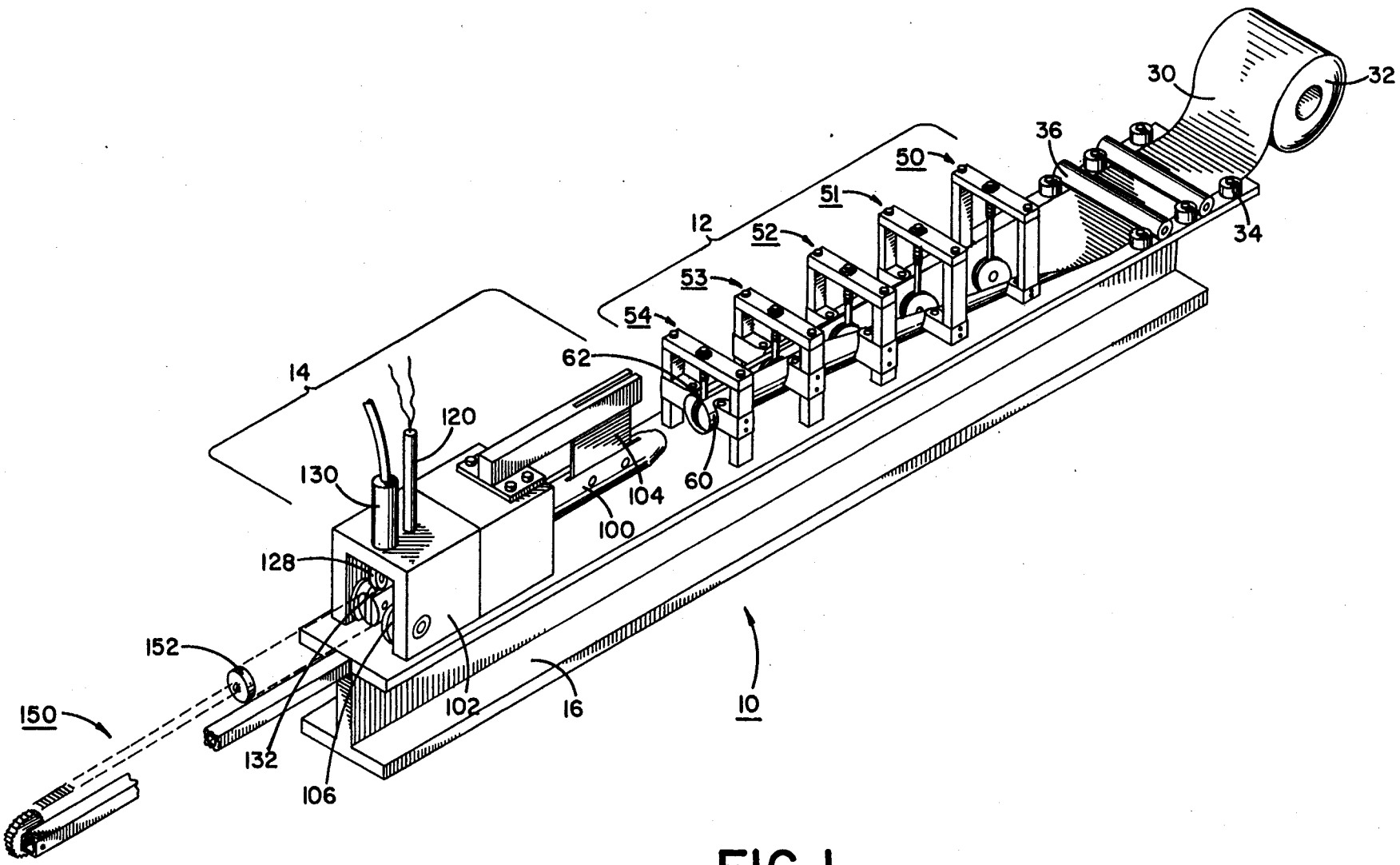
FIG. 1 is a perspective view of one embodiment of a tube forming/welding apparatus according to the present invention.

Referring now to the drawing, in which like or similar elements are given identical reference numerals throughout the various figures, FIG. 1 is a perspective view of a tube forming/welding apparatus, generally indicated by the reference numeral 10, which includes a tube forming section 12 and a tube welding section 14, both sections being mounted on a common base 16.

Tube forming section 12 is supplied with a continuous strip of flat stock 30 from a supply roll 32. A series of edge guide rollers, as at 34, and top guide rollers, as at 36, guide flat stock 30 into tube forming section 12. In tube forming station 12, flat stock 30 passes serially through tube forming stations 50, 51, 52, 53, and 54, in which the flat stock is gradually bent into a circular shape, and exits tube forming station 54 as tube 60 having a longitudinal slot 62.

Figures 2A, 2B, 2C, 2D, 2E:
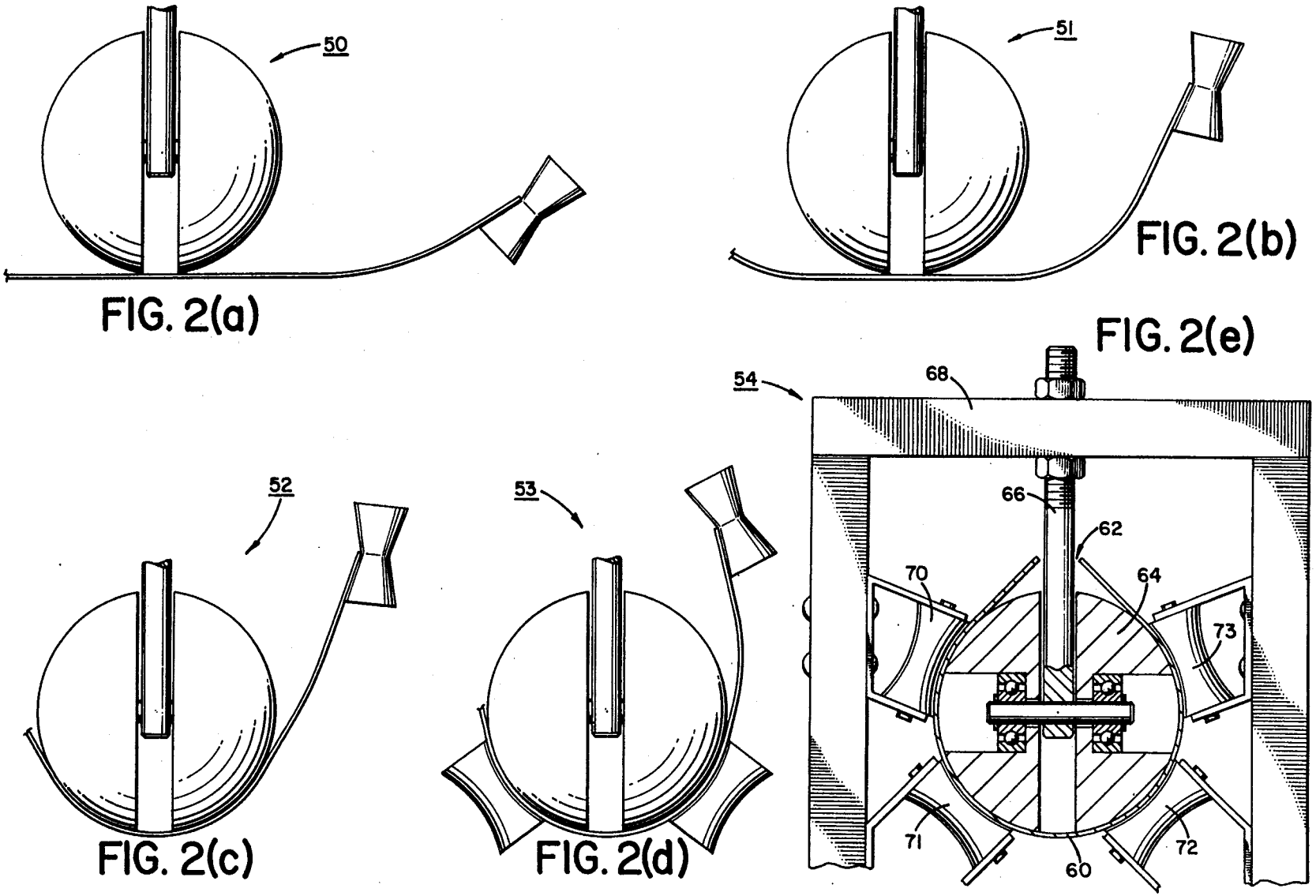
FIGS. 2(*a*) through 2(*e*) are partial front elevation views showing the tube forming apparatus of FIG. 1.
Figures 3, 4, 5:
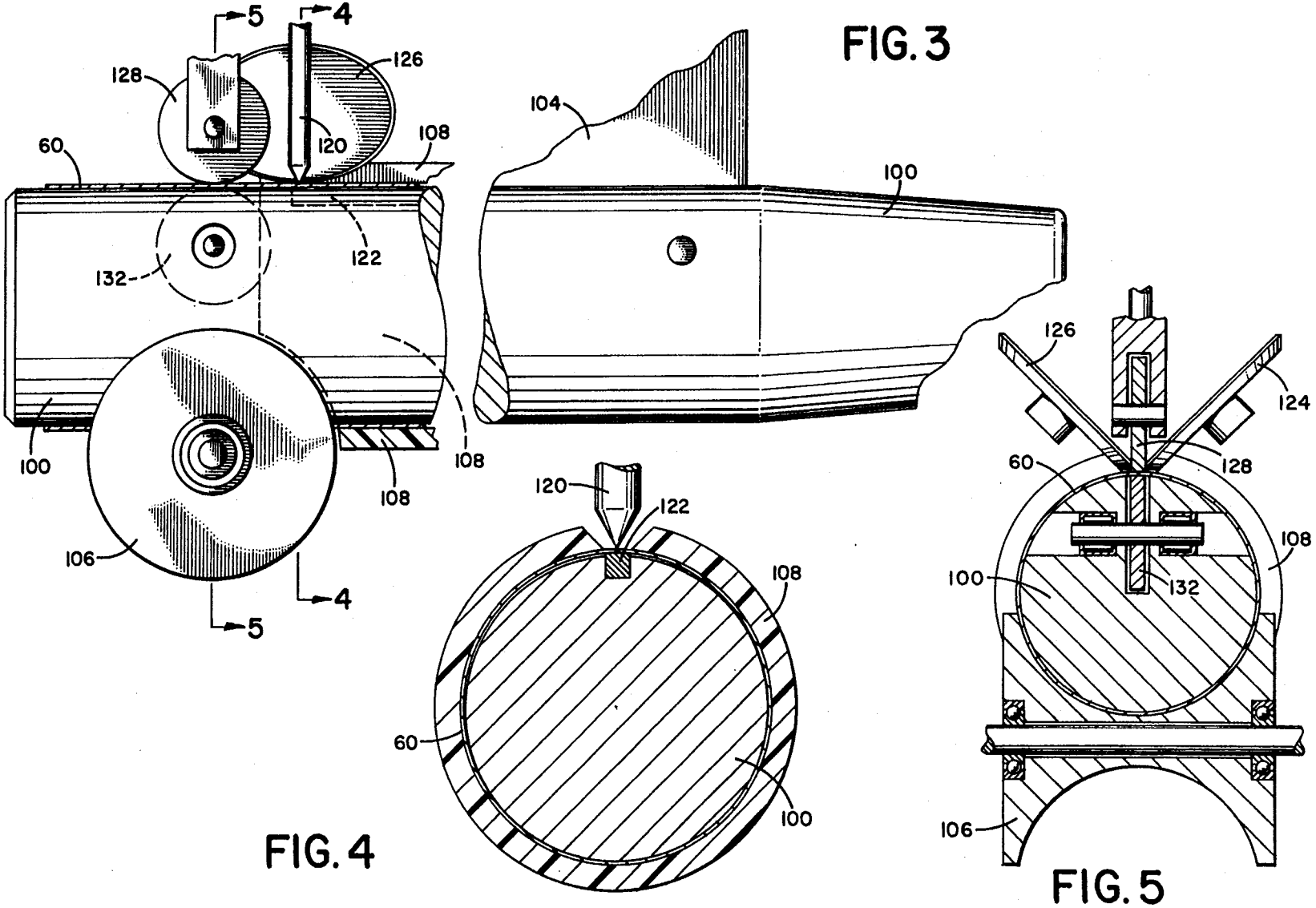
FIG. 3 is a fragmentary side elevation view of the tube welding apparatus of FIG. 1.
FIGS. 4 and 5 are sectional views of FIG. 3.

The function of the elements of each of tube forming stations 50, 51, 52, 53, and 54 may be also seen on FIGS. 2(*a*) through 2(*e*) of which FIGS. 2(*a*) through 2(*d*) are fragmentary front elevation views of tube forming stations 50 through 53, respectively, and FIG. 2(*e*) is a front elevation view, partially in cross section, of tube forming station 54, which is shown in more detail for illustrative purposes, the other tube forming stations being similarly constructed.

Tube forming station 54 includes an internal ball die 64 rotatably attached to a support shaft 66 which is fixedly mounted from a support frame 68 which is fixedly mounted on base 16 (FIG. 1). Forming rollers 70, 71, 72, and 73, rotatably mounted to support frame 68, rotatingly urge tube 60 against internal ball die 64 to give the tube its formed shape as it exits tube forming section 12 (FIG. 1).

From tube forming section 12, tube 60 enters tube welding section 14 where it is slidingly supported internally by a mandrel 100 which extends the length of a welding housing 102 and which is fixedly supported at the tube entry end of the welding housing by a pylon 104 and at the tube exit end of the welding housing by a roller support 106 which is journaled for rotation within the welding housing. The thickness of pylon 104 is sized so as to fit within slot 62 of tube 60.

Referring also to FIGS. 3 through 6, as tube 60 enters welding housing 102 the outer periphery of the tube is slidingly engaged by a sleeve 108, which sleeve has a slight taper from its tube entry end to its tube exit end so as to narrow the width of slot 62 as tube 60 passes through the annulus defined by mandrel 100 and the sleeve. Near the tube exit end of sleeve 108 is a welder 120 disposed so as to seal slot 62 as tube 60 passes beneath the welder. Disposed in the upper surface of mandrel 100 beneath welder 120 is a heat sink 122 which slidingly engages tube 60 and disposed on either side of the welder are roller heat sinks 124 and 126 which rollingly engage the tube. It can be seen (FIG. 3) that sleeve 108 extends beyond welder 120 to assure that the outer periphery of tube 60 is supported while the seam is being welded. It can also be seen (FIG. 5) that tube 60 passes between mandrel 100 and roller support 106 as it leaves welding housing 102.

Figure 6:
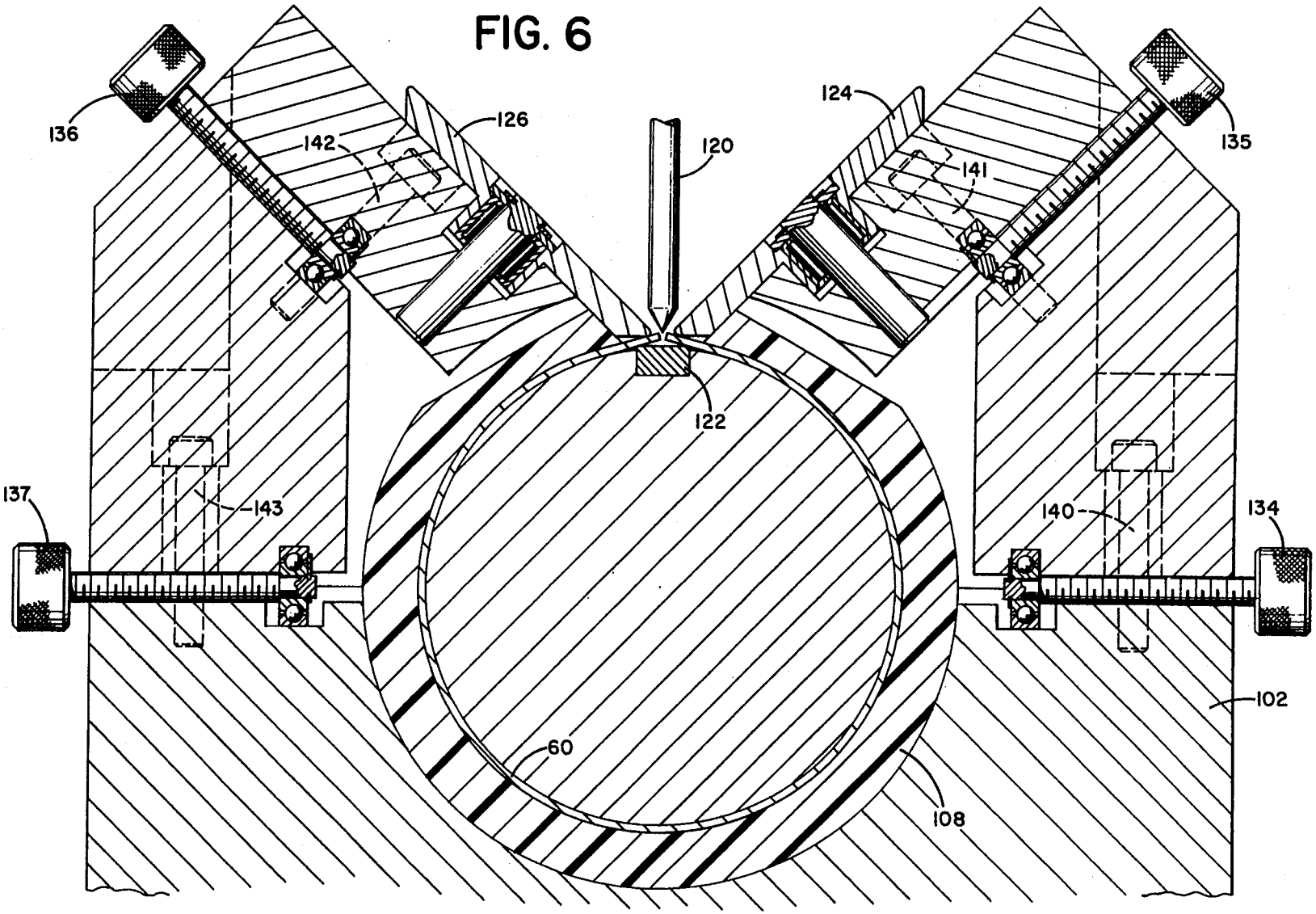
FIG. 6 is an end elevation view, partially in cross section, of the welding apparatus of FIG. 1.

FIG. 6 illustrates the preferred spacial relationships (not to correct relative scale) of welder 120, heat sink 122, and roller heat sinks 124 and 126 and also illustrates the means by which the positions of the roller heat sinks may be adjusted.

Heat sink 122 is fixedly mounted in mandrel 100 so that the heat sink extends slightly above the outer periphery of the mandrel, on the order of about a few thousandths of an inch. Roller heat sinks 124 and 126 are adjusted so that tube 62 is not forced completely against heat sink 122, but rather so that the tube engages the heat sink only at the corners thereof so that the edges of slot 62 angularly approach each other. The gap defined between the edges of roller heat sinks 124 and 126 is preferably in the range of about 0.040 to about 0.060 inch. As tube 60 is welded, the welded portion drops slightly so that the tube assumes a more circular shape.

The positions of roller heat sinks 124 and 126 to achieve the desired gap between the roller heat sinks and the desired position of tube 60 may be adjusted by means of adjustment screws 134, 135, 136, and 137 and set screws 140, 141, 142, and 143.

Following welding, tube 60 passes under a hydraulically controlled bead reduction and smoothing roller 128 the pressure of which roller is controlled by a hydraulic cylinder 130 fixedly mounted on welding housing 102 (FIG. 1). A backing roller 132 is journaled in mandrel 100 to oppose the force of smoothing roller 128 and the axis of roller support 106 is aligned with the axes of the smoothing and backing lollers to transmit that force to housing 102. Smoothing roller 128 is preferably disposed no more than 0.6–0.75 inches from welder 120, so that the smoothing operation takes place while the weld bead is still hot. It has been found that the pressure required for the smoothing operation when the weld bead is hot is about 1400 PSI, while about 13,000 PSI is required if the weld bead is cold.

The weld bead when formed is preferably slightly thicker than the tube wall, on the order of about 0.001 inch. After passing between smoothing and backing rollers 128 and 132, respectively, the thickness of the tube in the area of the weld is essentially the nominal thickness of the wall of tube 60.

A transport mechanism, generally indicated by the reference numeral 150 (FIG. 1), attached to a plug 152 in the end of tube 60 provides the force to feed flat sheet 30 into and through tube forming section 12 and tube 60 through welding section 14. Transport mechanism may be dimensioned so that any desired length of tube may be produced.

Tube forming section 12 is generally limited to thicker metal stock, say, about 0.020 inch thickness with a 4-inch diameter tube and about 0.006–0.008 inch thickness with a ¼-inch diameter tube.

Figure 7:
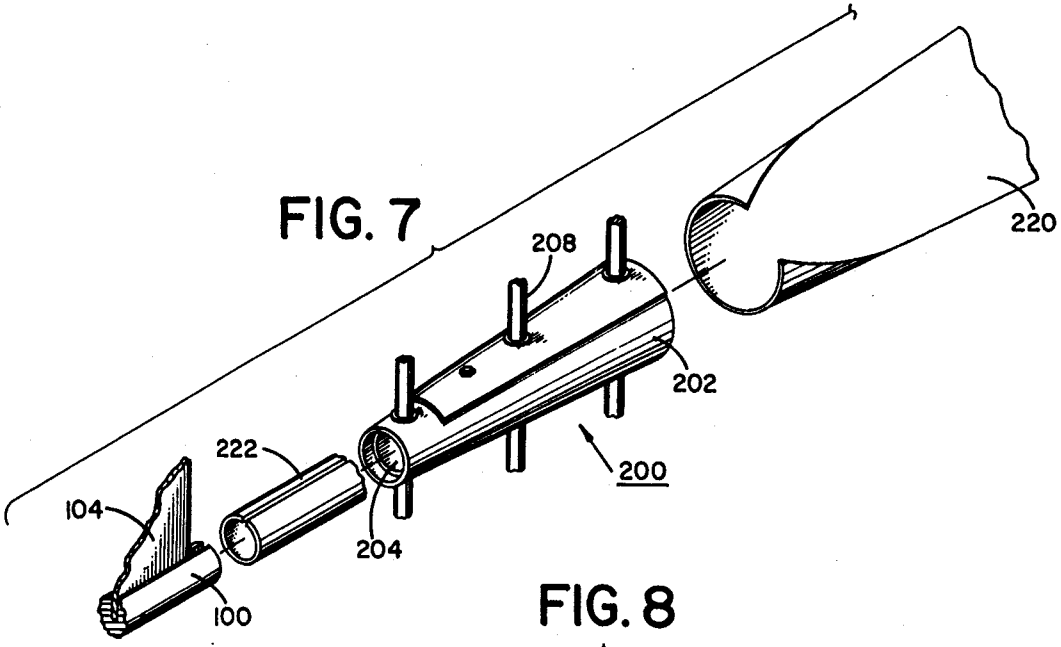
FIG. 7 is a an exploded perspective view of an alternative embodiment of a tube forming apparatus according to the present invention.
Figure 8:
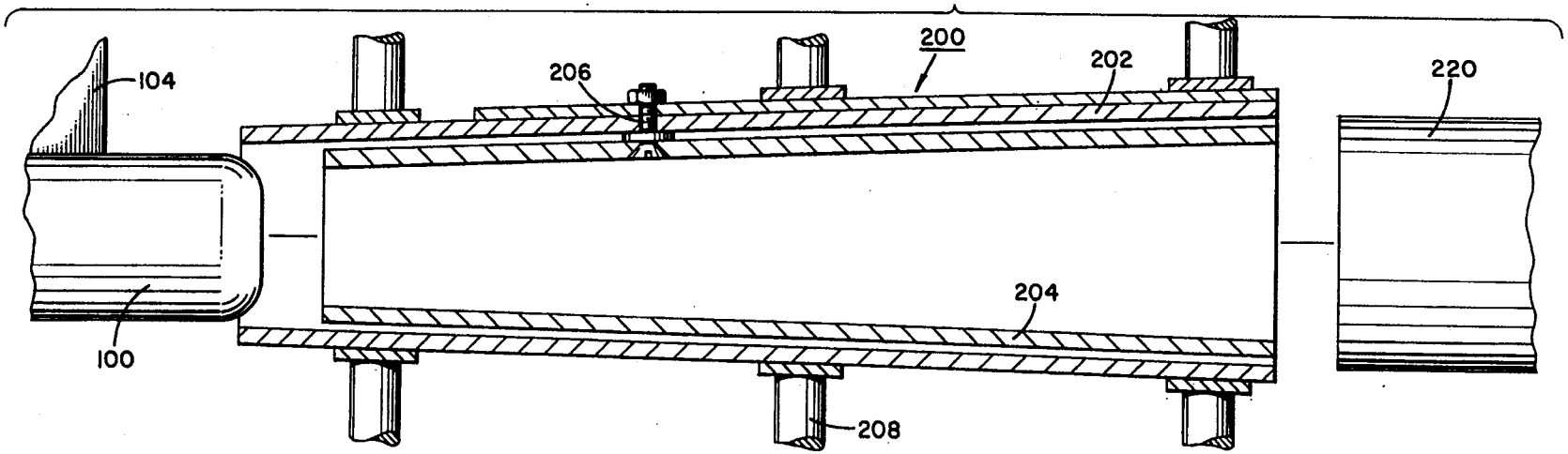
FIG. 8 is a side elevation view, partially in cross section, of the tube forming, apparatus of FIG. 7.

An alternative type of tube forming section, one that is satisfactory when using thinner metal stock, down to nearly the thickness of foil is illustrated on FIGS. 7 and 8, where it is generally indicated by the reference number 200. Tube forming section 200 includes an outer die 202 in the form of a truncated hollow cone and an inner die 204 in the form of a truncated cone, coaxially disposed, radially spaced apart by about one to two metal thicknesses, fixedly attached together by fastening means 206, and supported as at 208. A plurality of supports 208 are provided to maintain the dimensional integrity of tube forming section 200. Supports 208 would be fixedly tied together (not shown).

In use, flat sheet stock 220 is manually preformed to match the annulus formed by outer and inner cone dies 202 and 204, respectively, at the large end of tube forming section 200 and then urged therethrough. Upon exiting tube forming section 200, formed tube 222 slides over mandrel 100 of welding section 12, which mandrel extends a short distance into outer cone die 202. While tube may be formed using only outer cone die 202, it has been found that the use of the additional inner cone die 204 is preferable.

It will be understood that if tube forming section 200 is employed, it would be disposed on base 16 in place of tube forming section 12.

Figure 10:
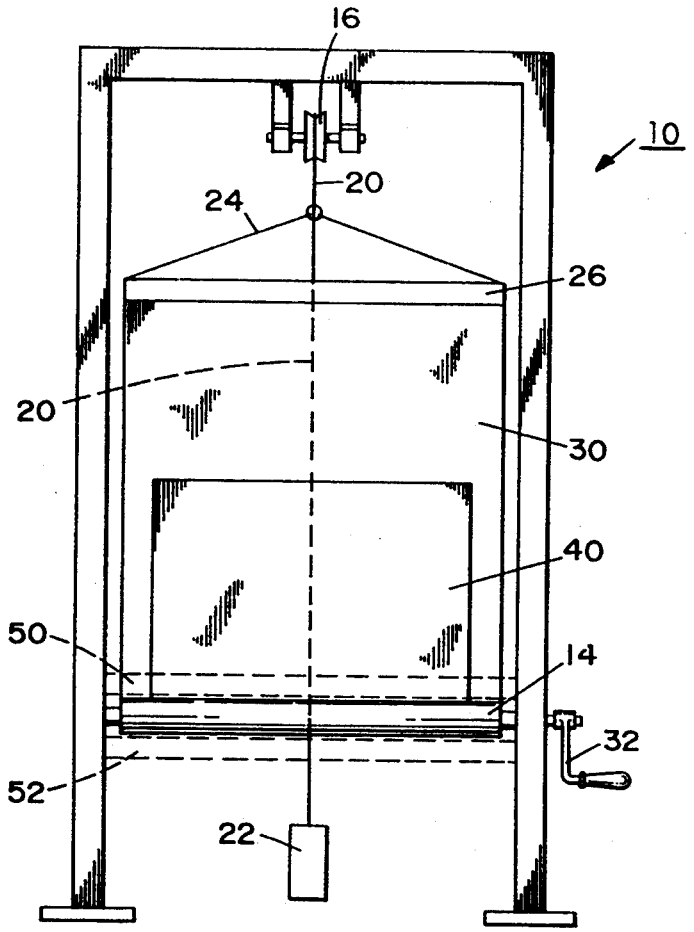
FIG. 10 is a front elevation view of a further alternative embodiment of a tube forming machine according to the present invention.
Figure 11:
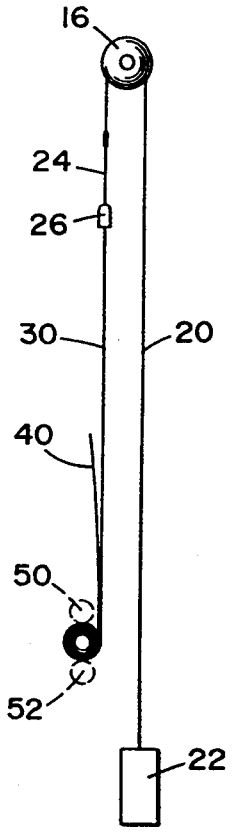
FIG. 11 is a side elevation of the tube forming machine of FIG. 10 (frame not shown).
Figure 12:
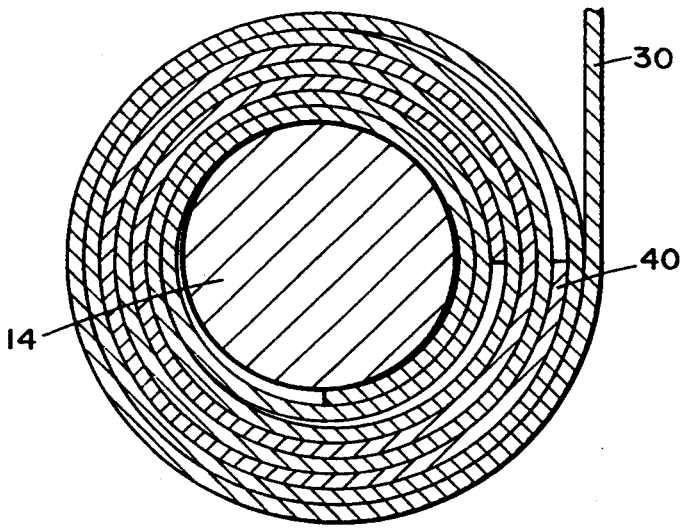
FIG. 12 is a cross-sectional view of a sheet of metal stock being formed in the machine of FIG. 10.

FIGS. 10–12 illustrate another method and apparatus for forming thin-wall tubing which method and apparatus are useful in forming thin-wall tubing of a wide range of diameters, lengths, and thicknesses and which avoid the kinks, scratches, and dents inherent in conventional tube forming apparati and especially avoid the problems inherent in multi-roller tube forming machines. Here, a tube forming machine according to this aspect of the present invention, generally indicated by the reference numeral 10, includes a frame 12 with a main roller 14 journaled for rotational movement at the lower end thereof and a pulley wheel 16 journaled for rotational movement at the upper end thereof, the main roller and the pulley wheel being disposed about parallel axes of rotation.

A cable 20 passing over pulley wheel 16 has attached to one end a weight 22 and to the other end a bridle 24 which is attached to the ends of a cross-member 26. Attached to, and extending between, main roller 14 and cross-member 26 is a sheet of flexible fabric 30 which is drawn taut by the force imposed by weight 22. It can be seen that flexible fabric 30 can be wound about main roller 14 by means of manually turning crank 32. It will be understood that non-manual means may be provided to rotate main roller 32 and such is within the intent of the present invention.

In use, an edge of a sheet of thin metal stock 40 is placed in the nip at main roller 4. Main roller 14 is then rotated clockwise so that metal stock 40 is tightly wound around the main roller between layers of flexible fabric 30, as is clearly indicated on FIG. 12. As seen on FIG. 12, metal stock 40 is rolled upon itself by a factor of about 2:1. Depending on the thickness of metal stock 40, the metal stock may be rolled upon itself by a factor more or less than 2:1 and may be rolled upon itself by a factor of 3:1 or more. When main roller 14 is subsequently rotated counterclockwise, metal stock is released from the sandwich formed with flexible fabric 30 and the stock springs back to a near-perfect tube without any kinks, scratches, or dents.

The phenomenon of "springback" is well known in the art and is described, for example, in "Metals Handbook," Ninth Ed., Volume 14, "Forming and Forging," copyright 1988 by ASM International, Metals Park, Ohio, which volume and the documents cited therein are incorporated by reference hereinto.

If the tube being formed by tube forming machine 10 is longer than on the order of about four to five feet, it may be necessary to provide supplemental rollers 50 and 52 above and below main roller 14, respectively, to prevent bending of the main roller to ensure that metal stock 40 is rolled evenly.

It has been found that, when rolling relatively heavy stock, say, about 0.013–0.015 inch or more in thickness into a relatively small roll, say, about 1 to 1½ inch in diameter, the leading edge of the stock forms a dent in the next turn of the tube. To avoid this problem, it has been found that placing a sheet of rubber between the stock and flexible sheet 30 during the rolling operation prevents this dent from forming. A sheet of silicone rubber about ⅛ inch thick and of about 70 Durometer hardness provides satisfactory results.

Tube forming machine 10 may be employed with the range of materials and thicknesses described above with respect to other embodiments of tube forming apparati of the present invention. Flexible sheet 30 is preferably formed from heavy Mylar or Dacron sailcloth and may be on the order of about 0.010 inch in thickness.

Figure 9:
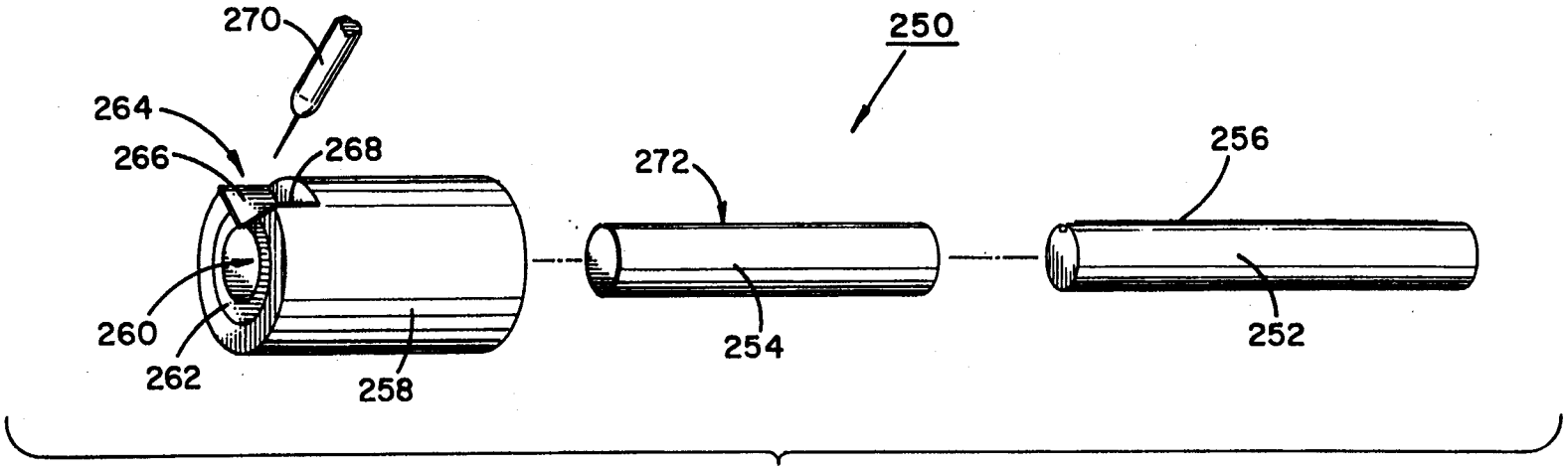
FIG. 9 is an exploded perspective view of an alternative embodiment of a tube welding apparatus according to the present invention.

FIG. 9 is an exploded perspective view of an alternative embodiment of a welding section according to the present invention, generally indicated by the reference numeral 250. Welding section 250 includes a mandrel 252 the OD of which is the ID of the tube 254 to be welded. Mandrel 252 has mounted in the upper surface and substantially along the length thereof a heat sink 256 which has the same function as heat sink 122 in welding section 14 described above. A hollow cylindrical shuttle 258 is provided having a circular interior passageway 260 the diameter of which is equal to the OD of tube 254. Shuttle 258 has the same function as sleeve 108 in welding section 14 described above and preferably has fixed therein a sleeve 262 formed from a material of relatively high lubricity defining the passageway.

Defined at one end of shuttle 258 is an opening 264 on the sides of which are fixedly mounted flat heat sinks 266 and 268 spaced apart the same as, and having the same function as, roller heat sinks 124 and 126 in welding section 14 described above. A welder 270 is positioned to weld the seam 272 in tube 254.

In use, tube 254 is formed, manually or otherwise, around mandrel 252, with the seam 272 of tube 254 located over heat sink 256. Mandrel 258 is then placed over tube 254 on mandrel 252 and moved along it while welder 270 welds seam 272, with heat sinks 264 and 266 urging the areas of the tube around the seam into partial contact with heat sink 256. Mandrel 258 may be moved by any conventional means and an engine lathe may be adapted for use with this embodiment of the invention.

Preferred dimensions of tube forming section 200 are functions of "D", the outer diameter of formed tube 222, and are approximately as follows:

ID of large end of outer cone die 202=1½ D to 1¾ D.

Axial distance between small ends of inner and outer cone dies 204 and 202=¼ D to ½ D.

Axial length of outer cone die=9/1 OD.

With either of the welding apparati described above, tubing can be produced having an OD of as small as about 0.3 inch. Wall thickness may be as small as about 0.002 with any practical diameter of tube. The only limitation on the length of the tubing is the ability to handle long lengths of the welded tubing.

Elements of the apparatus which slidingly contact metal tube or sheet are preferably formed from, or covered with, an ultra-high molecular weight polyethylene polymer. Heat sinks 122, 256, 266, and 268 and roller heat sinks 124 and 126 are preferably formed from copper. Smoothing and backing rollers 128 and 132 are preferably formed from an alumina ceramic material. Other elements of the invention may be formed from any suitable conventional materials known in the art. Welder 120 may be a tungsten inert gas welder or the equivalent.

It will thus be seen that the objects set forth above, among those made apparent from the preceding description, are efficiently attained and, since certain changes may be made in the above construction without departing from the scope of the invention, it is intended that all matter contained in the above description or shown on the accompanying drawing figures shall be interpreted as illustrative only and not in a limiting sense.

It is also to be understood that the following claims are intended to cover all of the generic and specific features of the invention herein described and all statements of the scope of the invention which, as a matter of language, might be said to fall therebetween.

I claim:

1. A method of forming a tube from a piece of continuous flat sheet stock, comprising:

(a) providing means to tightly wind a flexible sheet about a roller;

(b) placing said continuous flat sheet stock against said flexible sheet;

(c) winding said flexible sheet about said main roller, thereby tightly rolling said continuous sheet stock upon itself about said main roller between layers of said flexible sheet; and (d) releasing said rolled continuous sheet stock from between said flexible sheet and said roller and permitting said rolled continuous sheet stock to spring back to a tube shape.

2. A method, as defined in claim 1, wherein said flexible sheet is formed from heavy sailcloth.

3. A method, as defined in claim 1, wherein said flexible sheet is on the order of about 0.010 inch in thickness.

4. A method, as defined in claim 1, further comprising the step of placing a rubber sheet between said flat sheet stock and said flexible sheet such as to prevent the leading edge of said sheet stock from forming a dent in a subsequent turn of said sheet stock as said sheet stock is rolled upon itself.

5. A method, as defined in claim 4, wherein said rubber sheet is formed of silicone rubber.

6. A method, as defined in claim 5, wherein said rubber sheet is on the order of about $\frac{1}{8}$ inch in thickness and about 70 Durometer in hardness.

7. A method, as defined in claim 1, further including winding said continuous sheet about itself by a factor in the range of from about 2:1 to about 3:1.

* * * * *